United States Patent [19]

Hsieh et al.

[11] Patent Number: 4,565,625

[45] Date of Patent: Jan. 21, 1986

[54] BENEFICIATION OF PHOSPHATE ORES CONTAINING SURFACE ACTIVATED SILICA

[75] Inventors: Shuang-shii Hsieh; James R. Lehr, both of Florence, Ala.

[73] Assignee: Tennessee Valley Authority, Muscle Shoals, Ala.

[21] Appl. No.: 680,117

[22] Filed: Dec. 10, 1984

Related U.S. Application Data

[63] Continuation of Ser. No. 650,390, Sep. 14, 1984, now Defensive Publication No. T105,404.

[51] Int. Cl.[4] ..... B03D 1/02

[52] U.S. Cl. ..... 209/167; 252/61

[58] Field of Search ..... 209/166, 167; 252/61

[56] References Cited

U.S. PATENT DOCUMENTS

| | | | |
|---|---|---|---|
| 2,967,615 | 1/1961 | Goin | 209/166 |
| 4,189,103 | 2/1980 | Lawver et al. | 209/166 |
| 4,287,053 | 9/1981 | Lehr et al. | 209/167 |
| 4,486,301 | 12/1984 | Hsieh et al. | 209/167 |

*Primary Examiner*—Bernard Nozick

*Attorney, Agent, or Firm*—Robert A. Petrusek

[57] ABSTRACT

A phosphate ore flotation process comprising subjecting a phosphate ore containing surface-activated silica and silicates to froth flotation in the presence of a fatty-acid collector, recovering the phosphate concentrate from the overflow; removing the fatty acid collector from the phosphate concentrate in the presence of a sulfuric acid deoiling agent; subjecting the phosphate concentrate to a reversed froth flotation in the presence of a silica collector and a modifier, said silica collector being an amine and said modifier being either alkyl diphosphonic acid, or being HF; removing the separated silica from the overflow; and recovering the phosphate product in the underflow. The process of the present invention not only overcomes the problems of activated silica flotation, but also results in greatly improved grade and/or recovery of phosphate product in comparison to present conventional phosphate ore flotation processing.

2 Claims, No Drawings

BENEFICIATION OF PHOSPHATE ORES CONTAINING SURFACE ACTIVATED SILICA

The invention herein described may be manufactured and used by or for the Government for governmental purposes without the payment to us of any royalty therefor.

This application is a continuation of application Ser. No. 650,390, filed Sept. 14, 1984 now Defensive Publication No. T105404, for BENEFICIATION OF PHOSPHATE ORES CONTAINING SURFACE ACTIVATED SILICA.

INTRODUCTION

The present invention relates to a phosphate ore beneficiation process and more specifically to the use of either alkyl diphosphonic acids or HF as modifiers for beneficiating phosphate ores containing surface-activated silica.

BACKGROUND OF THE INVENTION

Current beneficiation practices for phosphate ores commonly utilize flotation as the principal step for separating phosphates from gangue minerals.

Most natural deposits of phosphate rock, such as those found in Florida, contain an objectionably high percentage of silica and silicates. Typical Florida ore as mined will contain approximately one-third phosphate mineral, one-third silica or siliceous gangue, and one-third clay. In the processing of these ores, they are first subjected to washing and screening operations in the "washer plant" to remove the clay constituents as slime and to recover coarse, pebble concentrate. Deslimed undersize (essentially −14 mesh to +150 mesh) from the screening operation is further separated at about 28 to 35 mesh. The coarse fraction is conditioned with tall oils and fuel oils and treated on concentrating tables, spiral concentrators, or spray belts. The fine mineral fraction is subjected to the Crago or "double-float" process which utilizes two stages of froth flotation. In the first stage, the flotation feed is conditioned in the anionic circuit with either caustic soda or $NH_3$, as well as fuel oil, tall oil mixtures of fatty acids, or oleic acid. The conditioned feed is then subjected to froth flotation where phosphates are floated and the underflow is discarded to waste. The product obtained from this flotation operation normally still contains so much silica that further treatment is necessary.

Accordingly, this intermediate product is de-oiled by scrubbing with sulfuric acid followed by desliming. The de-oiled, deslimed product is then subjected to a second stage of froth flotation in a cationic circuit with amines, where the silica is floated and discarded to waste. The underflow of the second stage of flotation is the final phosphate product.

However, some phosphate ores of potential commercial value contain surface-activated silica. This phenomenon results in unacceptable amounts of quartz silica sand being floated along with phosphate minerals in the fatty acid flotation circuit, which subsequently results in a heavy loss of phosphate minerals in the amine flotation circuit of the conventional "double float" process, supra.

The problem of surface-activated silica may occur naturally in phosphate ores, which are subjected to the geological or geochemical alternation process with underground water, such as leaching of source rock and adsorption or precipitation of metal ions, hydroxides, sulfate, or other chemical species on the mineral surface. The problem may also result from the contamination of surface water or processing water which may contain such cationic species as Ca, Mg, Al, or Fe, before or during the beneficiation process. These cations or cationic derivative species may activate silica surfaces so as to be responsive to fatty acid collectors, which subsequently results in an excessive amount being floated along with phosphate in the fatty acid flotation step in the two-stage process.

Phosphate ores which are beneficiated by the method of the present invention may be classified to desired size range by methods known in the art. A particle size smaller than about 28 mesh is preferably used for the flotation process. With larger particle size, an appreciable quantity of the gangue minerals may remain locked with the apatite. Furthermore, the larger particles are sometimes difficult to float. Very small particles, e.g., smaller than about 400 mesh, are removed by a desliming process. Although the slime may contain phosphate values, their relatively large consumption of reagents makes their beneficiation economically unattractive in relation to recoverable values of $P_2O_5$.

SUMMARY OF THE INVENTION

In practicing the method of the present invention, phosphate ores containing surface-activated silica are first beneficiated by conventional fatty acid flotation, in which the flotation feed is conditioned with caustic soda, fuel oil, tall oil mixtures of fatty acids or oleic acid. The conditioned feed is subsequently subjected to froth flotation wherein phosphates are floated and the underflow is discarded to waste. The product obtained from this flotation operation contains so much silica that further treatment is necessary. Accordingly, this rougher concentrate is refloated to remove additional silica as underflow, if so desired. The phosphate concentrate is then deoiled by scrubbing with sulfuric acid. At this point, in contrast to the conventional Crago process, in the practice of the instant invention desliming is not required after the deoiling stage. The deoiled product is subsequently subjected to froth flotation in a cationic circuit, in which either diphosphonic acid of HF is utilized as a modifier in the present invention, and an amine is utilized as a silica collector to float silica as waste. The underflow in this second flotation stage is the final phosphate product.

OBJECTS OF THE INVENTION

It is, therefore, a principal object of the present invention to provide an improved flotation process with high recovery efficiency and reasonable cost for the beneficiation of phosphate ores containing surface-activated silica. Still further and more general objects and advantages of the present invention will appear from the more detailed description set forth below, it being understood, however, that this more detailed description is given by way of illustration and explanation only and not necessarily by way of limitation since various changes therein may be made by those skilled in the art without departing from the true spirit and scope of the present invention.

In order that those skilled in the art may better understand how the present invention can be practiced, the following examples are given by way of illustration and not necessarily by way of limitation. It is noted that Examples V and VI herein are offered in the manner of negative examples, in that they illustrate what happens when the process of the instant invention is practiced without the use of diphosphonic acid or HF as modifier in the amine (cationic) flotation circuit.

EXAMPLES AND EMBODIMENTS

EXAMPLE I

A Florida phosphate ore containing surface-activated silica was used in this example. The minus 28-plus 150-mesh fraction which was used as flotation feed contained about 13.6 percent CaO, 8.6 percent P205 and 70 percent SiO2. A 500-gram flotation feed was first scrubbed at a pulp density of 50 percent for 5 minutes in a Denver (Model No. 12) laboratory scrubbing equipment, and then screened at 400 mesh to remove slime. The deslimed feed was introduced into the Denver conditioning equipment, and the pump density was adjusted to about 65 percent solids (by weight) by the addition of sufficient water. The slurry was adjusted to an alkaline reading by using NaOH, and then conditioned for 2.5 minutes with 0.6 kg of fatty acid (Century MO5 from Union Camp Corporation, Jacksonville, Fla., was used) and 1.2 kg of fuel oil per ton of feed. The pH at the end of conditioning was 9.2. After the conditioning, the pulp was transferred to a Denver 500-gram flotation cell and diluted with sufficient tap water. The pulp was then floated to collect phosphate rougher concentrate. Silica and silicates were rejected as rougher sink. After the rougher flotation, the rougher concentrate was returned to the flotation cell and re-floated to reject additional silica as first cleaner sink.

After the first cleaner flotation, the phosphate concentrate (first cleaner float) was returned to flotation cell and scrubbed with 0.5 kg $H_2SO_4$ per ton of feed as "deoiling" agent to remove fatty acid and fuel oil from the phosphate mineral surface. The pulp was then conditioned for 1 minute with 0.3 kg per ton of Monsanto's Dequest 2010 (hydroxyethylidene diphosphonic acid) as modifier, and then for an additional ½ minute with 0.2 kg per ton of dodecylamine hydrochloride as silica collector. The pH was 5.1. Silica was floated as waste (second cleaner float) and final phosphate product was recovered as sink (second cleaner sink). The results are shown in Table I below. The $P_2O_5$ recovery was 88.0 percent and the grade was 30.0 percent $P_2O_5$.

TABLE I

| Product | Wt % | Analysis, % | | | Distribution, % | |
|---|---|---|---|---|---|---|
| | | CaO | $P_2O_5$ | $SiO_2$ | $P_2O_5$ | $SiO_2$ |
| Rougher sink | 61.8 | 2.1 | 1.1 | 91.1 | 7.8 | 81.7 |
| First cleaner sink | 6.2 | 5.2 | 2.9 | 85.4 | 2.0 | 7.7 |
| Second cleaner sink | 25.7 | 46.0 | 30.0 | 7.8 | 88.0 | 2.9 |
| Second cleaner float | 6.4 | 5.1 | 3.2 | 85.3 | 2.2 | 7.7 |
| Head | 100.1 | 13.8 | 8.8 | 68.9 | 100.0 | 100.0 |

EXAMPLE II

The phosphate ore flotation was performed as outlined in Example I, supra, except that Dequest 2010 was increased to 0.4 kg per ton feed as modifier in the amine flotation circuit (second cleaner flotation). The pH was 4.8. The flotation results are recorded in Table II below. The $P_2O_5$ recovery was 86.6 percent and the grade was 30.0 percent $P_2O_5$, which is similar to that of Example I, supra.

TABLE II

| Product | Wt % | Analysis, % | | | Distribution, % | |
|---|---|---|---|---|---|---|
| | | CaO | $P_2O_5$ | $SiO_2$ | $P_2O_5$ | $SiO_2$ |
| Rougher sink | 62.0 | 2.0 | 0.9 | 90.4 | 6.5 | 81.4 |
| First cleaner sink | 8.4 | 7.3 | 4.3 | 82.6 | 4.2 | 10.1 |
| Second cleaner sink | 24.7 | 45.7 | 30.0 | 7.9 | 86.6 | 2.8 |
| Second cleaner float | 4.9 | 7.5 | 4.6 | 80.6 | 2.6 | 5.7 |
| Head | 100.0 | 13.5 | 8.6 | 68.9 | 99.9 | 100.0 |

EXAMPLE III

The phosphate ore flotation was performed as outlined in Example I, supra, except that HF was used as a modifier in the amine flotation circuit. The dosage of HF was 0.3 kg per ton feed, and the pH was 4.3. The flotation results are recorded in Table III below. The $P_2O_5$ recovery was 87.1 percent and the grade was 29.9 percent $P_2O_5$, which is similar to that of Examples I–II, supra.

TABLE III

| Product | Wt % | Analysis, % | | | Distribution, % | |
|---|---|---|---|---|---|---|
| | | CaO | $P_2O_5$ | $SiO_2$ | $P_2O_5$ | $SiO_2$ |
| Rougher sink | 61.8 | 2.0 | 1.0 | 91.9 | 7.2 | 81.1 |
| First cleaner sink | 8.8 | 7.2 | 4.3 | 82.5 | 4.4 | 10.4 |
| Second cleaner sink | 25.0 | 45.8 | 29.9 | 8.8 | 87.1 | 3.1 |
| Second cleaner float | 4.4 | 4.4 | 2.6 | 86.7 | 1.3 | 5.4 |
| Head | 100.0 | 13.5 | 8.6 | 70.1 | 100.0 | 100.0 |

EXAMPLE IV

The phosphate ore flotation was performed as outlined in Example III supra, except that the dosage of HF as modifier in the amine circuit was decreased to 0.2 kg per ton feed. The pH was 4.8. The flotation results are recorded in Table IV below. The $P_2O_5$ recovery was 84.6 percent and the grade was 30.3 percent $P_2O_5$, which is similar to that of Examples I–III, supra.

TABLE IV

| Product | Wt % | Analysis, % | | | Distribution, % | |
|---|---|---|---|---|---|---|
| | | CaO | $P_2O_5$ | $SiO_2$ | $P_2O_5$ | $SiO_2$ |
| Rougher sink | 61.5 | 2.2 | 1.1 | 93.2 | 7.9 | 80.8 |
| First cleaner sink | 8.8 | 6.6 | 4.0 | 84.1 | 4.1 | 10.4 |
| Second cleaner sink | 24.0 | 46.7 | 30.3 | 6.8 | 84.6 | 2.3 |
| Second cleaner float | 5.7 | 8.3 | 5.2 | 81.0 | 3.4 | 6.5 |
| Head | 100.0 | 13.6 | 8.6 | 70.9 | 100.0 | 100.0 |

EXAMPLE V

The phosphate ore flotation was performed as outlined in Example I, except that no diphosphonic acid (Dequest 2010) or HF was added as a modifier in the amine flotation circuit. The dosage of dodecylamine hydrochloride was 0.1 kg per ton feed and the pH was 6.0. The flotation results are shown in Table V below. The $P_2O_5$ recovery was 74.3 percent and the grade was 28.0 percent $P_2O_5$; both recovery and grade were significantly lower than those of Examples I–IV, supra, which used diphosphonic acid or HF as a modifier in the amine flotation circuit.

TABLE V

| Product | Wt % | Analysis, % | | | Distribution, % | |
|---|---|---|---|---|---|---|
| | | CaO | $P_2O_5$ | $SiO_2$ | $P_2O_5$ | $SiO_2$ |
| Rougher sink | 58.3 | 2.0 | 1.0 | 91.1 | 6.8 | 76.9 |
| First cleaner sink | 10.2 | 5.6 | 3.4 | 84.8 | 4.0 | 12.5 |
| Second cleaner sink | 22.7 | 43.8 | 28.0 | 12.0 | 74.3 | 3.9 |

TABLE V-continued

| Product | Wt % | Analysis, % CaO | $P_2O_5$ | $SiO_2$ | Distribution, % $P_2O_5$ | $SiO_2$ |
|---|---|---|---|---|---|---|
| First cleaner float | 8.8 | 22.4 | 14.5 | 52.7 | 14.9 | 6.7 |
| Head | 100.0 | 13.9 | 8.9 | 69.1 | 100.0 | 100.0 |

EXAMPLE VI

The phosphate ore flotation was performed as outlined in Example I supra, except that the pulp from the "deoiling" stage was washed and deslimed at 400 mesh to remove slime, and that no diphosphonic acid (Dequest 2010) or HF was used as a modifier in the subsequent amine flotation circuit. The dosage of dodecylamine hydrochloride was 0.08 kg per ton feed and the pH was 7.5. The flotation results are shown in Table VI below. The $P_2O_5$ recovery was 78.3 percent and the grade was 29.7 percent $P_2O_5$. The recovery was significantly lower than those of Examples I–III, supra, in which diphosphonic acid or HF was used as a modifier in the amine flotation circuit.

TABLE VI

| Product | Wt % | Analysis, % CaO | $P_2O_5$ | $SiO_2$ | Distribution, % $P_2O_5$ | $SiO_2$ |
|---|---|---|---|---|---|---|
| Rougher sink | 55.8 | 2.1 | 1.2 | 92.4 | 7.7 | 73.2 |
| First cleaner sink | 14.9 | 7.4 | 4.6 | 82.8 | 7.9 | 17.5 |
| Second cleaner sink | 22.8 | 46.0 | 29.7 | 7.8 | 78.3 | 2.5 |
| Second cleaner float | 6.5 | 12.2 | 8.1 | 74.0 | 6.1 | 6.8 |
| Head | 100.0 | 13.6 | 8.7 | 70.5 | 100.0 | 100.0 |

The results of the data from the above six examples illustrate that either diphosphonic acid or HF are effective modifiers for the beneficiation of phosphate ore containing surface-activated silica. Diphosphonic acid, as in Examples I and II, supra, or HF, as in Examples III and IV, supra, is used in the amine flotation circuit to increase the efficiency of phosphate/silica separation and therefore to enhance the recovery of phosphate product. The amine flotation can be conducted with the same pulp obtained from the preceding deoiling stage without further washing and desliming treatment when diphosphonic acid or HF is used as a modifier. The grade and/or phosphate recovery will be greatly reduced, as in Examples V and VI, supra, without using these modifier agents.

INVENTION PARAMETERS

After sifting and winnowing through data presented above as well as other data available to use, we have determined that the operating range as well as the preferred conditions for carrying out the instant invention related to use of modifying agents in the beneficiation of phosphate ores containing surface activated silica are summarized below:

| Modifying agent | Operating range | Preferred range |
|---|---|---|
| HF (Kg/ton) | 0.01–2.0 | 0.1–0.5 |
| Diphosphonic acid (Kg/ton) | 0.01–1.0 | 0.1–0.5 |

While we have shown and described particular embodiments of our invention, modifications and variations thereof will occur to those skilled in the art. We wish it to be understood, therefore, that the appended claims are intended to cover such modifications and variations which are within the true scope and spirit of our invention.

What we claim as new and desire to secure by Letters Patent of the United States is:

1. An ore flotation process which comprises the steps of:

(1) subjecting a Florida phosphate ore containing surface-activated silica and silicates to washing and sizing means wherefrom is removed as flotation feed the minus 28-plus 400-mesh fraction;

(2) subsequently beneficiating said flotation feed by adjusting the pulp density thereof, through the addition of aqueous medium thereto, to about 65 percent solids; adjusting the pH thereof, by mixing therewith predetermined quantities of caustic soda sufficient to raise the pH to at least about 9; and conditioning same by intimately mixing therewith predetermined quantities of fatty acid and fuel oil;

(3) removing the resulting conditioned flotation feed from step 2 supra and introducing same into first froth flotation means wherein the phosphate values therein are recovered in the float therefrom as intermediate product and the underflow therefrom is discarded to waste;

(4) subsequently deoiling the resulting intermediate phosphate concentrate from step 3 supra by scrubbing same with sulfuric acid to remove said fatty acid and fuel oil residuals from the phosphate mineral surfaces introduced theronto in step 2 supra;

(5) subsequently introducing the resulting deoiled first froth flotation intermediate product into reverse second froth flotation means and intimately mixing therewith as silica modifier from about 0.01 to about 2.0 kg of HF per ton of feed or from about 0.01 to about 1.0 kg of alkyl diphosphonic acid per ton of feed and mixtures thereof, along with predetermined quantities of an amine sufficient to be utilized therewith as a silica collector to float said silica as waste; and (6) recovering as an underflow from said second reverse froth flotation means, as product, substantial amount of the phosphate values introduced into said process as said froth flotation feed fraction;

said process characterized by the fact that the use of the silica modifier(s) in step 5 thereof effects an increase in the recovery of the phosphate values in step 6 thereof, of at least about 10 percent greater than would be realized without the use of said silica modifier(s).

2. The process of claim 1 wherein said alkyl diphosphonic acid is hydroxyethylidene diphosphonic acid and wherein said amine is dodecylamine hydrochloride.

* * * * *